US006210277B1

(12) United States Patent
Stefan

(10) Patent No.: US 6,210,277 B1
(45) Date of Patent: Apr. 3, 2001

(54) GAME OF CHANCE

(76) Inventor: Alexander Stefan, 216 E. Arby Ave., Las Vegas, NV (US) 89119

( * ) Notice: Subject to any disclaimer, the term of this patent is extended or adjusted under 35 U.S.C. 154(b) by 0 days.

(21) Appl. No.: 09/162,422

(22) Filed: Sep. 28, 1998

(51) Int. Cl.[7] ..... A63F 9/24

(52) U.S. Cl. ..... 463/27; 463/26; 463/16; 463/20

(58) Field of Search ..... 463/13, 20, 25, 463/26, 27, 28, 42; 273/142 R, 143 R, 293, 292

(56) References Cited

U.S. PATENT DOCUMENTS 5,577,731 * 11/1996 Jones ..... 273/292
5,645,486 * 7/1997 Nagao et al. ..... 463/27
6,019,374 * 2/2000 Breeding ..... 273/292

* cited by examiner

*Primary Examiner*—Valencia Martin-Wallace
*Assistant Examiner*—Julie Kasick
(74) *Attorney, Agent, or Firm*—Quirk & Tratos

(57) ABSTRACT

A plurality of gaming machines are linked together and controlled by a central computer. A bonus system is incorporated into the play of the gaming machines and the central computer tracks the bonus system activity and makes the appropriates payouts. In the play of the gaming machines, a portion of the coins wagered are allocated to a bonus payout. Each player plays his gaming machines for a fixed time period (say 30 seconds) and the player with the highest payout during that time period wins the bonus jackpot. However, if two players tie during the time period, then the bonus payout money carries over to the next round of play. This allows the bonus payout to accumulate to a potentially large sum of money over a series of time periods if two or more players repeatedly tie each round of play. Eventually, a single player will have the highest winning amount during a time period and, not having been tied by another player, win a large bonus payout.

10 Claims, 1 Drawing Sheet

GAME OF CHANCE

This invention relates to a game of chance suitable for play in a gaming casino, and more particularly to a game of chance in which a plurality of gaming machines are linked together and the players play for a common jackpot to be awarded to the player who achieves the highest winning combination without ties during a preselected time period.

BACKGROUND OF THE INVENTION

For many years, gaming establishments have offered to the patrons games of chance in the nature of mechanical and electro-mechanical slot machines and video gaming machines.

In the case of a slot machine, players wager one or more coins, tokens or credits to activate pay lines and to make wagers on each pay line. Most slot machines have a "Bet One" button and a "Bet Max" button to allow the player to select the number of credits that the player wishes to wager on that particular spin of the reels. The player then activates the game by pulling a handle or pressing a "Spin" button. The reels spin and symbols are displayed on one or more pay lines when the reels stop spinning. If the player achieves a winning combination of symbols on an active pay line, then the player is a winner. The amount awarded to the player is based on the symbol combinations achieved on the pay line. A pay table shows the amount the player wins for any particular winning combination of symbols.

In the case of video gaming machines, which are typically video draw poker machines (but may be other games of chance displayed to the player on a video gaming machine such as Twenty-One or other poker games), the player also wagers one or more coins, tokens or credits to play the game. Video poker machines also have a "Bet One" button and a "Bet Max" button to allow the player to select the number of credits that the player wishes to wager on that particular deal of the cards. The player then activates the game and a hand of cards is dealt to the player and displayed on a video screen display. If the game is video draw poker, the player then selects which cards of his initial hand he wishes to hold and replacement cards are displayed to the player for the cards the player has discarded. The final player's hand is used to determine whether the player is a winner or a loser based on whether the player has achieved a winning poker hand combination as shown in an accompanying pay table. Typically, the winning hand combinations are based on poker hand rankings with a Royal Flush being the highest winning hand and a pair of Jacks or Better being the lowest winning hand. Any lesser hands are losing hands. The amount that the player wins is based on the poker hand ranking achieved and the amount wagered by the player.

In order to attract players, casinos offer many different kinds of bonuses on their slot machines and video gaming machines. Some of the bonuses offered to the players require the player to make a separate or additional wager to be eligible for the bonus. The more popular bonus games do not cost players any additional money since the bonus is built into the percentages of the games.

In many instances, the bonuses are funded by retaining a certain percentage of coins played, often from the last coin played when the player wagers the maximum number of coins, tokens or credits allowed on the gaming machine which is typically done by the player pressing the "Bet Max" button. In many gaming machines, the player is required to play the maximum number of coins, tokens or credits in order to be eligible for special bonus payouts.

For example, there is a statewide progressive jackpot in the State of Nevada known as the MEGABUCKS slot machine in which a player can win in excess of five million dollars paid as an annuity, but the player is only eligible for this large jackpot if the player wagers three coins, tokens or credits. If the player wagers only one or two coins, tokens or credits and the winning MEGABUCKS symbols appear on the pay line, the player wins a much smaller jackpot.

The large payoff bonuses (such as the MEGABUCKS slot machine) are accumulated progressively and it usually takes a considerable length of time (such as weeks or even months) for a player to win the large MEGABUCKS payoff. This is because the mathematical odds of winning the MEGABUCKS payoff are in excess of thirty million to one.

Other gaming machines (such as the WHEEL OF FORTUNE slot machine, the TOTEM POLE slot machine and video draw poker machines) offer what are known as instant bonus payouts which a player can win after each spin of the reels or after each hand of cards, but the bonus amounts are usually quite small. For example, in conventional video draw poker, a player who wagers a single credit and achieves a Royal Flush is paid odds of 250-for-1. But if a player plays the maximum number of credits, normally five credits, on a video draw poker machine and achieves a Royal Flush, the player is paid four thousand credits (which are odds of 800-for-1 for each credit played) which provides the player a bonus over the amount paid for playing a single credit.

There is a need for a new system of applying bonuses to gaming devices that allows large bonuses to be paid as often as every day, every hour or even more often. It is proposed to utilize a new and unique bonusing system to be called the Skin Game and apply this bonusing system to electro-mechanical slot gaming machines and other video gaming machines such as video poker gaming machines.

It is an object of the present invention to provide a new and unique bonus system to electro-mechanical slot gaming machines and other video gaming machines such as video poker gaming machines in which a plurality of such gaming machines are linked together and the players compete for a common bonus payout.

It is a feature of the present invention to link together a plurality of gaming machines and provide a common bonus jackpot to be won by the player who achieves the highest winning play over a predetermined time period, such as thirty seconds. A portion of the amounts wagered by the players during the time period are accumulated for the bonus payout. If during a particular time period of play, more than one player achieves the same highest winning amount, then the amount of the bonus payout carries over to the next round of play.

It is an advantage of the present invention that large bonus payout amounts can be generated in a short period of time. Players are encouraged to continue playing as the bonus amounts increase because players are not eliminated from being eligible to win the bonus amount by having small winning hands during any particular round of play since only two players need have a tying winning amount in order for the bonus payout to carry over to the next round of play.

Other objects, features and advantages of the present invention will become apparent from a consideration of the following detailed description.

SUMMARY OF THE INVENTION

A plurality of gaming machines are linked together and controlled by a central computer. A bonus system is incorporated into the play of the gaming machines and the central computer tracks the bonus system activity and makes the appropriates payouts.

In the play of the gaming machines, a portion of the coins wagered are allocated to a bonus payout. Each player plays his gaming machines for a fixed time period (say 30 seconds) and the player with the highest payout during that time period wins the bonus jackpot. However, if two players tie during the time period, then the bonus payout money carries over to the next round of play. This allows the bonus payout to accumulate to a potentially large sum of money over a series of time periods if two or more players repeatedly tie each round of play. Eventually, a single player will have the highest winning amount during a time period and, not having been tied by another player, will win a large bonus payout.

DETAILED DESCRIPTION OF THE PREFERRED EMBODIMENTS

Figure 1:
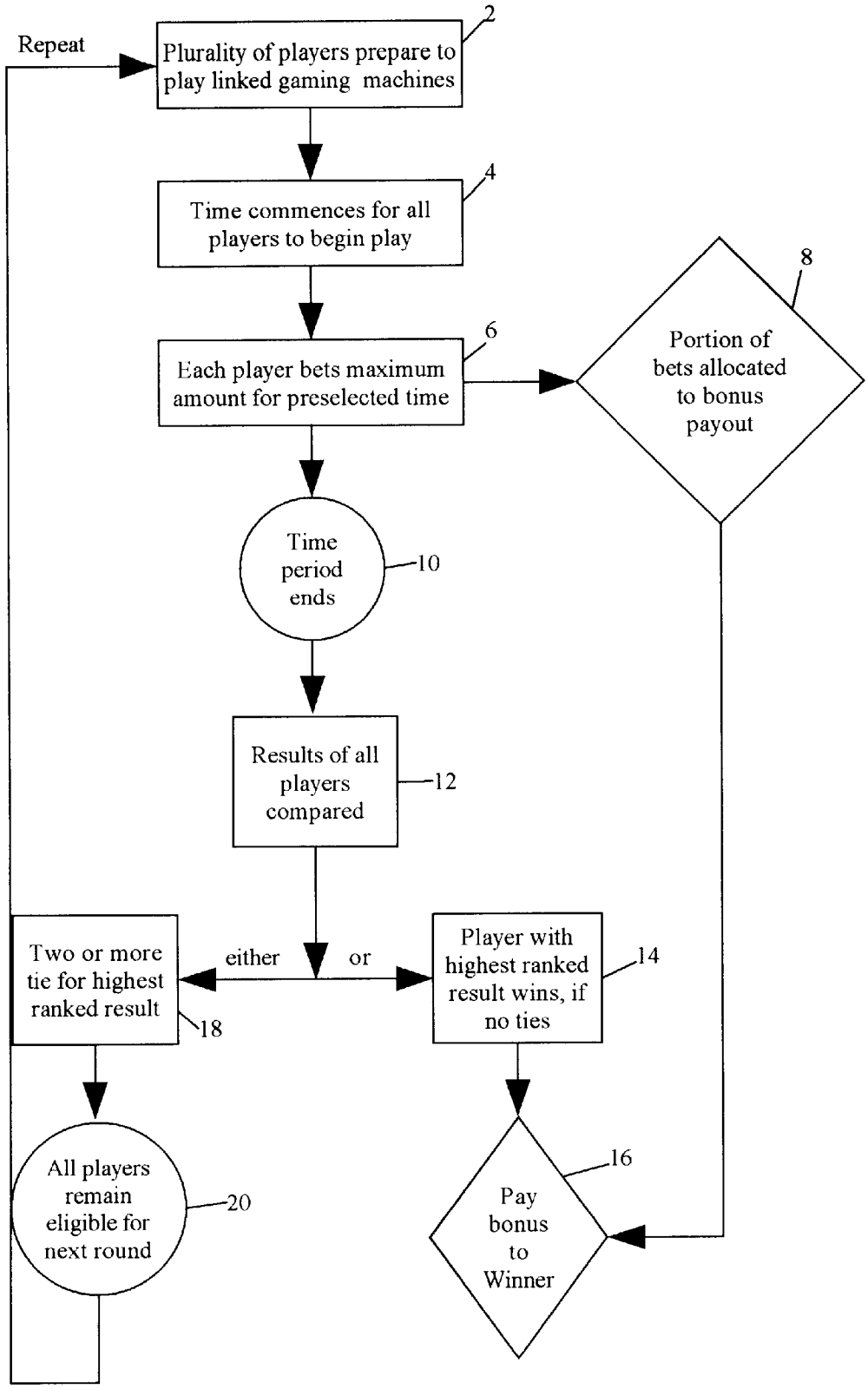
FIG. 1 is a block diagram representing the flow of play in the game.

A summary of a preferred method of play of the invention is shown in the flow chart of FIG. 1. First, a plurality of players prepare to play linked gaming machines (2). Next (4), all players commence play in a contest at the same time. Each player bets the maximum amount permitted by the machine for a period of time preselected by the house (6). A portion of the bets made by each player during the time of the game is allocated to a bonus payout (8).

At the end of the preselected time period (10), the results of all players are compared (12). The player who has achieved the highest ranked result during the contest round wins (14), unless two or more players tie for the highest ranked result (18). If there is a winner, the bonus payout is paid to the winner. If two or more players tie for the highest ranked result (18), then there is no winner, but all of the initial players remain eligible for the next round of play (20). Thereafter, play re-commences with portions of all bets continuing to be paid for a bonus payout, until only one player has the highest ranked result with no ties.

A plurality of gaming machines are linked together and electronically connected to a central computer and become part of a bonus system feature. The gaming machines can be any of the conventional gaming machines found in a gaming casino, such as slot machines, video poker machines or other electronic gaming machines.

The number of gaming machines linked together is not critical. For example, as few as eight or ten gaming machines located on a gaming machine carousel can be linked together. Alternatively, two or more machine carousels can be linked together or even all of the gaming machines in a single gaming establishment or even groups of gaming machines from gaming establishments in remote, separate locations can be linked together. As will be apparent from the following description, the more gaming machines linked together, the higher the potential for large or very large bonus payouts.

Each gaming machine operates in its conventional manner during the play of the gaming machine. But in addition to the conventional manner of play of the gaming machine, each gaming machine that is linked to the bonus system provides the player with an opportunity to win a bonus payout in addition to whatever winnings the player may achieve during the conventional play of the gaming machine.

A bonus system is incorporated into the play of the gaming machines and the central computer tracks the bonus system activity and makes the appropriates payouts. In the operation of the bonus system during the play of the gaming machines, a portion of the coins wagered are allocated to a bonus payout.

Each player plays his gaming machines for a fixed time period (say 30 seconds) and the player with the highest payout during that time period wins the bonus jackpot. However, if two players tie with the same payout amount during the time period, then the bonus payout money carries over to the next round of play. This allows the bonus payout to accumulate to a potentially large sum of money over a consecutive group of time periods if two or more players repeatedly tie each round of play. Eventually, a single player will have the highest winning amount during a time period and, not having been tied by another player, will win a large bonus payout.

The bonus payout can be accumulated in any appropriate manner, beginning either as a zero amount or after being seeded with a starting amount, say $10 or $20. In the preferred embodiment, a percentage of each coin, token or credit wagered by each player is added to the bonus payout so that the amount of the bonus payout will increment progressively during the play of the game until it is won by a player.

As an example of the manner in which the method of play of the present invention would occur, a group of fifty $1 video pokers machines are linked together electronically to the Skin Game central computer which will track the bonus activity and distribute the bonus payout to a winning player.

For the purposes of this example, all fifty video poker machines are being played and each player is playing the maximum five coins, tokens or credits for a total wagered of $250.00. Five percent ($12.50) of the total wagered is allocated to the bonus payout. There is nothing critical about the percentage of the wagers allocated to the bonus payout; the amount can be more or less than five percent. Players play for a preselected time period, say thirty seconds. There is nothing critical about the length of the preselected time period and time periods which are shorter or longer than thirty seconds can be used. The winner will be the player with the highest ranking poker hand (minimum "Three of a Kind") during the thirty second time period. In the preferred embodiment of the present invention, "Three of a Kind" is used as the minimum qualifying hand for a player to win the bonus payout, but other higher or lower ranking poker hands can be used as the minimum qualifying hand.

All "Three of a Kinds" have the same value, so three Aces will have the same value as three Deuces. This equal ranking of poker hands also applies for Straights, Flushes, Full Houses, Four of a Kinds, Straight Flushes and Royal Flushes so that two or more players each having a Straight Flush will be considered as having tie hands regardless of the actual cards in each Straight Flush.

If, for example, only one player achieves a Three of a Kind as the highest hand during a thirty second time period round of the game, that player wins the bonus payout (the "Skin" of $12.50) and he is paid as credits accumulated on the credit meter of his poker machine. But, if two or more players achieve a Three of a Kind as the highest hand, then there is a tie. Two tie—everybody ties. In this case, the "Skin" of $12.50 automatically carries over to the next time period of thirty seconds. If all fifty players play maximum coins in the next thirty second time period round of the game, the bonus payout (the "Skin") for that time period will be $25.00.

During any one time period, each player can play more than one hand and the same five percent of each wager will go to the bonus payout so the bonus payout can increase more than $12.50 during each time period. Players can leave the game at any time and new players playing maximum coins can join the game at any time. Thirty second time periods have been chosen to allow slow players to play the game and to allow fast players to play as many hands as they wish. The best hand of the faster player will count as his highest hand during any particular time period or round of the game.

Another example will show other various possibilities that can occur during the method of play of the present invention. For example, a plurality of gaming establishments that could be under common ownership have all of their video poker machines linked together using a wide area progressive linking system. Then say four thousand video poker machines are played simultaneously over a twelve hour period with all players making the maximum wager each time a hand is played. Assume that all of the video poker machines of $1.00 denomination machines and one percent of the total $5.00 wagered on each hand is added to the bonus payout total. If each player plays four hands during each thirty second time period, then the total amount wagered is $20,000.00 and the one percent of the total amount wagered being added to the bonus jackpot would be $200.00.

If there is no tie hand during the first thirty second time period, then the player with the highest winning hand would win $200.00 (plus whatever amount the player won for the poker hand, say Three of a Kind which would normally be fifteen credits).

If there was never a tie during any of the thirty second time periods over the twelve hour total time period, then 1440 skins each worth $200.00 would be won by the players.

If there was one tie each time before a skin was won over the twelve hour total time period, then 720 skins each worth $400.00 would be won by the players.

If there were four ties each time before a skin was won over the twelve hour total time period, then 288 skins each worth $1000.00 would be won by the players.

If there were ties for an hour until a skin was won over the twelve hour total time period, then only 12 skins each worth $24,000.00 would be won by the players.

Instead of using basic draw poker machines, the Skin Game method of the present invention can be played with groups of other poker machines or even slot machines. By creating a "point system" to equalize the win amounts on various gaming machines, the Skin Game can even be played with a mixture of different gaming machines linked together.

In the preferred embodiment of the present invention, only by playing maximum coins can a player be eligible for the Skin Game bonus payout. However, any gaming machine that is otherwise linked into the Skin Game group can also be played with any number of coins less than the maximum number of coins at any time so the casino's normal game play will not be interrupted.

Other variations of the Skin Game are possible. In order to assure a workable group size, the main computer can be programmed to provide "fictional players" so that a minimum number of players, say fifty, are always playing the game. When "fictional players" are participating, the fictional wagers by the "fictional players" are not added to the bonus payout, but rather prevent a single player from always winning the bonus payout. Should a "fictional player" achieve the highest ranking poker hand during a thirty second round of play, the "fictional player" does not win the bonus payout, but rather the skin carries over to the next thirty second round of play. Furthermore, to encourage player participation, the bonus payout can be seeded at a starting level, such as $10 or $20 or even higher amounts depending on the denomination of the gaming machines that are linked together.

Another variation would allow a player to wager an extra (sixth) coin after the initial deal of a five card poker hand to become eligible for the bonus payout. This sixth coin would not be added to the bonus payout but would go the gaming establishment.

The Skin Game method of the present invention can be played by linking various gaming establishments at remote locations together electronically and then linking one more gaming machines at each location together to create a large group of gaming machines all participating in the Skin Game. The larger the group of gaming machines linked together, the higher the probability that the bonus payout will be quite high before a single player achieves that one high hand that will win that the player the bonus payout amount. It is also possible to practice the present invention via the Internet by linking thousands of players simultaneously through a main server to track the wagering activity.

It is anticipated that the Skin Game will make poker and slot machine play more exciting because there will be bonus jackpot winners every few minutes with the possibility that the amount of a "skin" could be quite substantial.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a game of chance comprising:

a) providing a plurality of gaming machines linked together to a common computer, each machine having a maximum wager permitted to be played;

b) a plurality of players each playing one of the gaming machines;

c) each player playing the gaming machine for the same preselected period of time and each player making the maximum wager permitted to be played on the gaming machine to be eligible for a bonus payout;

d) allocating a portion of each wager to the bonus payout;

e) awarding the bonus payout to the player who achieves a winning combination ranked higher than that achieved by any other player during the preselected time period, unless two or more players tie by achieving the same higher-ranked winning combination during the time period;

f) if a tie occurs, carrying over the amount of the bonus payout to a next round of play wherein all of the plurality of players are eligible to play in the next round;

g) repeating steps c)–f) until only one player achieves a winning combination during a round of play ranked higher than all other players; and h) awarding the bonus payout to said one player.

2. The method of claim 1 in which the preselected time period is thirty seconds.

3. The method of claim 1 in which the maximum wager is equivalent to five coins.

4. The method of claim 1 in which the portion of each wager allocated to the bonus payout is five percent.

5. The method of claim 1 in which at least one of the plurality of players is a fictional player programmed into the main computer, wherein a said fictional player is programmed to play each round of the game but does not contribute to the bonus payout.

6. A method of playing a game of chance comprising:

a) providing a plurality of video poker gaming machines linked together to a common computer;

b) a plurality of players each playing one of the video poker gaming machines;

c) each player playing the video poker gaming machine for a preselected period of time and each player making a required wager to be eligible for a bonus payout;

d) allocating a portion of each wager to the bonus payout;

e) awarding the bonus payout to the player who achieves a winning combination ranked higher than that achieved by any other player during the preselected time period, unless two or more players tie by achieving the same higher-ranked winning combination during the time period;

f) if a tie occurs, carrying over the amount of the bonus payout to a next round of play wherein all of the plurality of players are eligible to play in the next round;

g) repeating steps c)–f) until only one player achieves a winning combination during a round of play ranked higher than all other players; and h) awarding the bonus payout to said one player.

7. The method of claim 6 in which the preselected time period is thirty seconds.

8. The method of claim 6 in which the maximum number of coins permitted to be played is five.

9. The method of claim 6 in which the portion of each wager allocated to the bonus payout is five percent.

10. The method of claim 6 in which the player must have at least a Three of a Kind in order to be eligible to win the bonus payout.

* * * * *